US010392142B2

(12) United States Patent
Dominguez, Jr. et al.

(10) Patent No.: US 10,392,142 B2
(45) Date of Patent: Aug. 27, 2019

(54) BAG FORMER ASSEMBLY AND METHOD OF USING SAME

(71) Applicant: J & F BUSINESS, INC., Pasadena, TX (US)

(72) Inventors: John Dominguez, Jr., Pasadena, TX (US); John Dominguez, III, Houston, TX (US)

(73) Assignee: J & F BUSINESS, INC., Pasadena, TX (US)

( * ) Notice: Subject to any disclaimer, the term of this patent is extended or adjusted under 35 U.S.C. 154(b) by 311 days.

(21) Appl. No.: 15/362,368

(22) Filed: Nov. 28, 2016

(65) Prior Publication Data

US 2017/0174371 A1 Jun. 22, 2017

Related U.S. Application Data

(60) Provisional application No. 62/269,706, filed on Dec. 18, 2015, provisional application No. 62/393,191, filed on Sep. 12, 2016.

(51) Int. Cl.

| | |
|---|---|
| ***B65B 9/22*** | (2006.01) |
| ***B65B 59/04*** | (2006.01) |
| ***B65B 31/04*** | (2006.01) |

(52) U.S. Cl.
CPC ..... *B65B 9/22* (2013.01); *B65B 31/045* (2013.01); *B65B 59/04* (2013.01)

(58) Field of Classification Search
CPC ..... B65B 9/22; B65B 31/044; B65B 31/045; B65B 59/04
See application file for complete search history.

(56) References Cited

U.S. PATENT DOCUMENTS

| | | | | |
|---|---|---|---|---|
| 7,523,597 | B2 * | 4/2009 | Dominguez, Jr. | B65B 9/22 493/302 |
| 9,463,886 | B2 * | 10/2016 | Dominguez, Jr. | B65B 9/22 |
| 2005/0208185 | A1 * | 9/2005 | Sugimura | B65B 1/16 426/115 |
| 2006/0162290 | A1 * | 7/2006 | Kakita | B65B 31/045 53/434 |
| 2012/0270711 | A1 * | 10/2012 | Dominguez, Jr. | B65B 9/22 493/186 |

* cited by examiner

*Primary Examiner* — J C Jacyna
(74) *Attorney, Agent, or Firm* — Greenberg Traurig LLP

(57) ABSTRACT

A former assembly for forming and fabricating bags from flexible sheet material is provided. The former assembly can include a base plate having an aperture that extends from a first surface to a second surface thereof. A bracing post can be attached to the base plate on the first surface proximate the aperture. An annular space can be formed between the tube and the base plate. The annular space can be sized for the passage of the flexible sheet material.

9 Claims, 13 Drawing Sheets

BAG FORMER ASSEMBLY AND METHOD OF USING SAME

CROSS REFERENCE TO RELATED APPLICATIONS

This application claims the benefit, and priority benefit, of U.S. Provisional Patent Application Ser. No. 62/269,706, filed Dec. 18, 2015, titled "IMPROVED BAG FORMER ASSEMBLY," and U.S. Provisional Patent Application Ser. No. 62/393,191, filed Sep. 12, 2016, titled "IMPROVED BAG FORMER ASSEMBLY," the disclosures of which are incorporated by reference herein in their entireties

BACKGROUND

1. Field of Invention

This invention relates generally to product packaging, and more particularly to a bag former assembly for preparing product packaging and methods of using same.

2. Description of the Related Art

It is known in the art to utilize bag former assemblies to fabricate packaging for bulk consumer products, particularly foodstuffs. Certain previous bag former assemblies lack desired stability and are difficult and time consuming to disassemble and reassemble for cleaning and maintenance purposes.

SUMMARY

Various illustrative embodiments of a former assembly for forming bags from flexible sheet material are provided. The former assembly can have a base plate having an aperture formed therein. A single bracing post can be attached to the base plate proximate to the aperture. The former assembly can also have a fill tube with an interior region. The fill tube can be slidingly passable through the aperture in the base plate. An annulus can be located between the fill tube and the base plate and sized for the passage of the flexible sheet material. The former assembly can also have a contact arm extending from the fill tube and engageable with the single bracing post when the fill tube is slidingly passed through the aperture in the base plate. A gas intake nozzle can be disposed on the contact arm. A gas flow conduit can be disposed on the contact arm and can be capable of delivering gas from the gas intake nozzle to the interior region of the fill tube.

In certain aspects, a plurality of contact arms can be attached to the fill tube at spaced apart locations. The contact arms can each be engageable with the single bracing post. The plurality of contact arms can include an upper positioned contact arm and a lower positioned contact arm when the assembly is positioned in an upright orientation. The gas intake nozzle and the gas flow conduit can be disposed on one or more of the upper positioned contact arm and the lower positioned contact arm. The gas flow conduit can be disposed on the contact arm and can include a first gas flow conduit. The former assembly can also include a second gas flow conduit disposed within the interior region of the fill tube. The first gas flow conduit and the second gas flow conduit can be connected such that inert gas can flow therebetween.

In certain illustrative embodiments, a former assembly for forming bags from flexible sheet material is provided. The former assembly can have a base plate having an aperture formed therein. A single bracing post can be attached to the base plate proximate to the aperture. The bracing post can have a receiving groove formed along a side edge thereof. A fill tube can be slidingly passable through the aperture in the base plate with an annulus between the fill tube and the base plate sized for the passage of the flexible sheet material. A contact arm can extend from the fill tube, and the receiving groove can be sized to receive the contact arm when the fill tube is slidingly passed through the aperture in the base plate.

In certain aspects, a locking orifice can be formed in the contact arm, and a bracing orifice can be formed in the bracing pos. A stabilizer pin can be slidingly fittable through the bracing orifice and within the locking orifice and capable of securing the contact arm to the bracing post. The contact arm can be slidingly fittable in the receiving groove and aligned perpendicular to the bracing post. A plurality of contact arms can be attached to the fill tube at spaced apart locations, the contact arms each being slidingly fittable into the receiving groove. A locking orifice can be formed in each of the plurality of contact arms and a plurality of bracing orifices can be formed in the bracing post.

In certain illustrative embodiments, a method of removing a fill tube from a former assembly for fabricating bags from flexible sheet material is provided. The former assembly can have a base plate with an aperture formed therein, a single bracing post attached to the base plate proximate to the aperture, and a fill tube with a contact arm attached thereto. The fill tube can be disposed in the aperture in the base plate. The bracing post can have a receiving groove formed on a side wall thereof that is sized to receive the contact arm such that the contact arm is disposed therein. The method can include the steps of slidingly passing the fill tube out of the aperture in the base plate, and slidingly removing the contact arm out of the receiving groove such that the contact arm is no longer disposed within the receiving groove. In certain aspects, a locking orifice can be formed in the contact arm, and a bracing orifice can be formed in the bracing post. A locking pin can be removed from the locking orifice and the bracing orifice to unsecure the contact arm from the bracing post.

In certain illustrative embodiments, a method of replacing a fill tube from a former assembly for fabricating bags from flexible sheet material is provided. The former assembly can have a base plate with an aperture formed therein, a single bracing post attached to the base plate proximate to the aperture, and a fill tube with a contact arm attached thereto. The fill tube can be disposed in the aperture in the base plate. The bracing post can have a receiving groove formed on a side wall thereof that is sized to receive the contact arm such that the contact arm is disposed therein. The method can include the steps of slidingly passing the fill tube through the aperture in the base plate, and engaging the contact arm with the bracing post and slidingly fitting the contact arm into the receiving groove such that the contact arm is disposed within the receiving groove. In certain aspects, a locking orifice can be formed in the contact arm, and a bracing orifice can be formed in the bracing post. A locking pin can be inserted into the locking orifice and the bracing orifice to secure the contact arm to the bracing post

BRIEF DESCRIPTION OF THE DRAWINGS

A better understanding of the presently disclosed subject matter can be obtained when the following detailed description is considered in conjunction with the following drawings, wherein.

Figure 1:
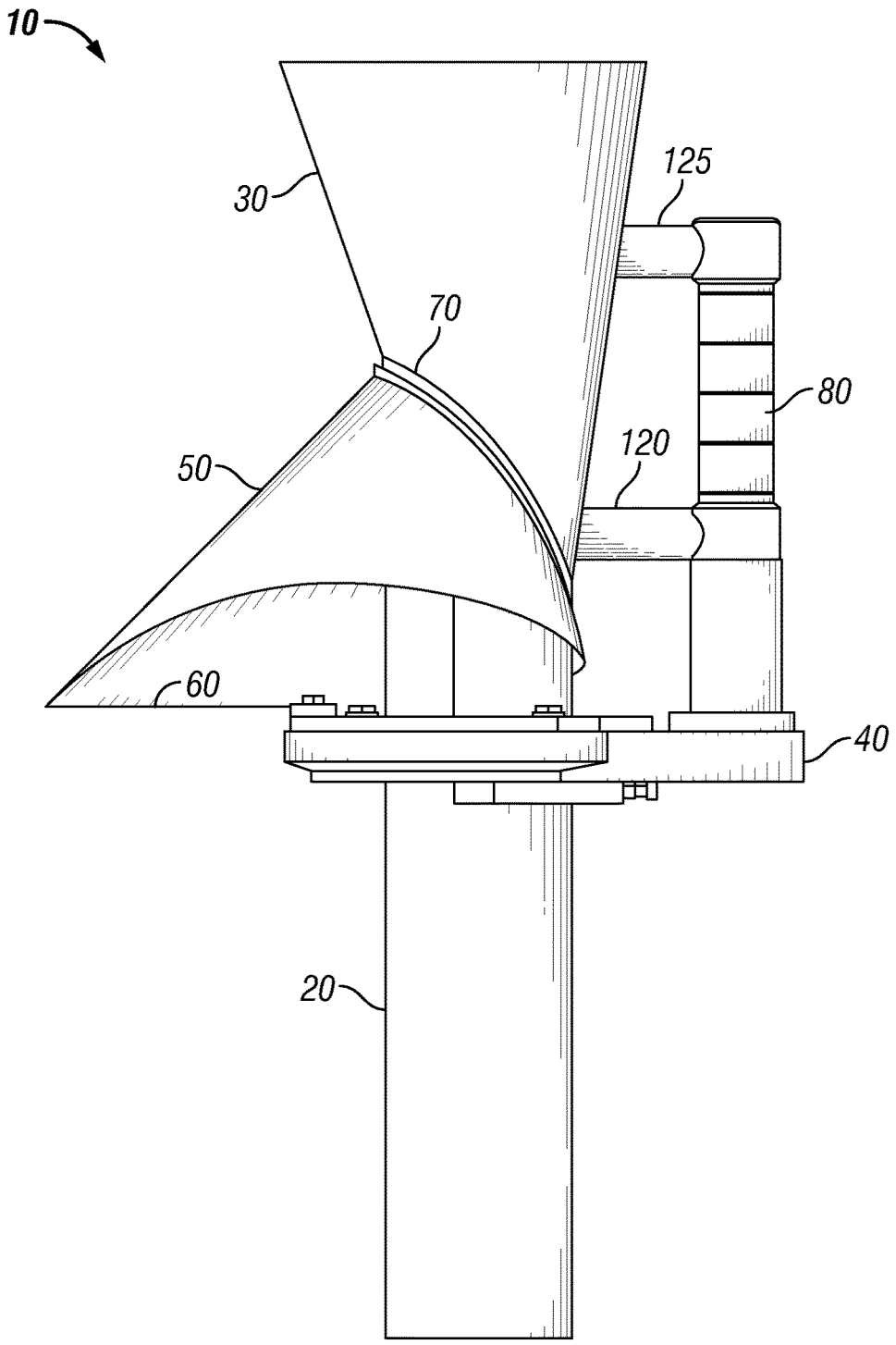
FIG. 1 is a side view of a former assembly in an illustrative embodiment.
Figure 2:
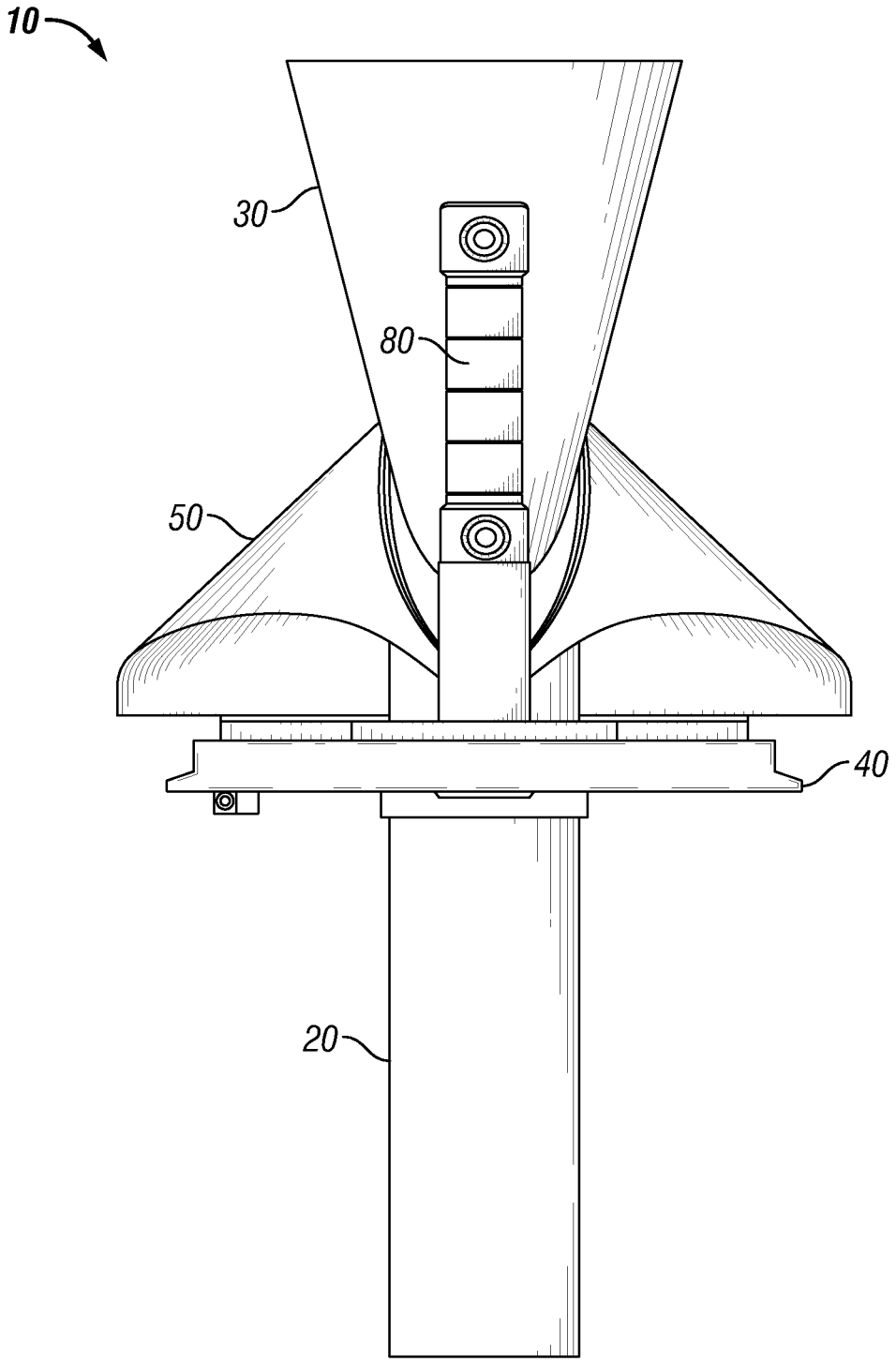
FIG. 2 is a front view of a former assembly in an illustrative embodiment.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter as defined by the appended claims.

DETAILED DESCRIPTION

Referring now to FIGS. 1-16, various illustrative embodiments of a former assembly 10 are provided herein. Former assembly 10 can be utilized to form and fabricate bags from flexible sheet material. Former assembly 10 can be reproducibly positioned on automated equipment for filling said bags with a selected product. Methods of using assembly 10 for removing or replacing a fill tube for fabricating bags from flexible sheet material are also provided herein.

In certain illustrative embodiments, former assembly 10 can comprise a generally cylindrical fill tube 20 whose upper portion may have a progressively expanding diameter so as to form funnel section 30 which facilitates entry of product into fill tube 20.

Base plate 40 provides structural support for various components of former assembly 10 and may be equipped with conventional means for bracing or securing assembly 10 on automated packaging equipment. A central aperture 310 (see FIG. 11) in base plate 40 is sized to accommodate fill tube 20 such that an annulus 320 is formed in the space between fill tube 20 and base plate 40 when fill tube 20 is positioned inside base plate 40. Annulus 320 permits the passage of packaging material through base plate 40 around the outer circumference of fill tube 20.

Base plate 40 also supports a former wing 50 by means of wing support 60 (see FIG. 1). Former wing 50 surrounds but does not contact tube 20, leaving gap 70 between the two members for the passage of flexible sheet material. The sheet material can be advanced through assembly 10 via a pull down mechanism.

The existence of gap 70 and annulus 320 in base plate 40 requires that fill tube 20 be suspended from one or more points above base plate 40. At least one suspension point must also be above gap 70 so as to not interfere with the movement of the sheet material across former wing 50.

In certain illustrative embodiments, a bracing post or stanchion 80 can be securely attached at its bottom surface (not shown) to base plate 40 with a plurality of bolts (or other fastening means) so as to prevent any rotation of bracing post 80 on base plate 40. Various illustrative embodiments of bracing post 80 are shown in FIGS. 5-9 herein.

Figure 3:
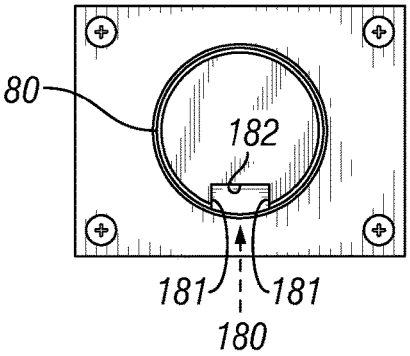
FIG. 3 is a top view of a bracing post for a former assembly in an illustrative embodiment.
Figure 4:
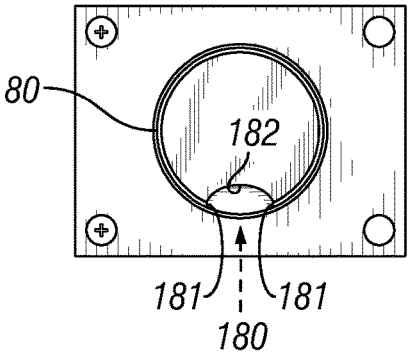
FIG. 4 is a top view of a bracing post for a former assembly in an illustrative embodiment.
Figure 5:
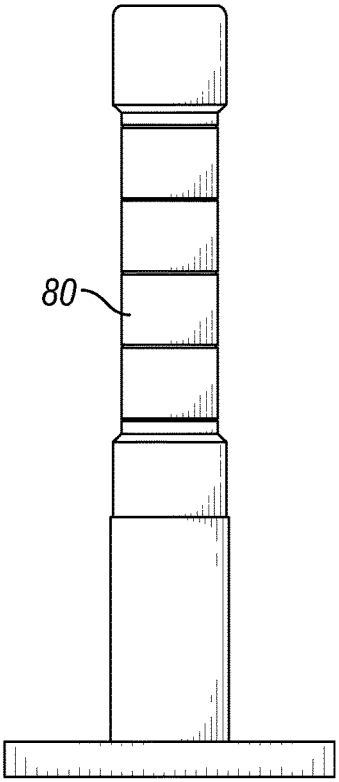
FIG. 5 is a front view of a bracing post for a former assembly in an illustrative embodiment.
Figure 6:
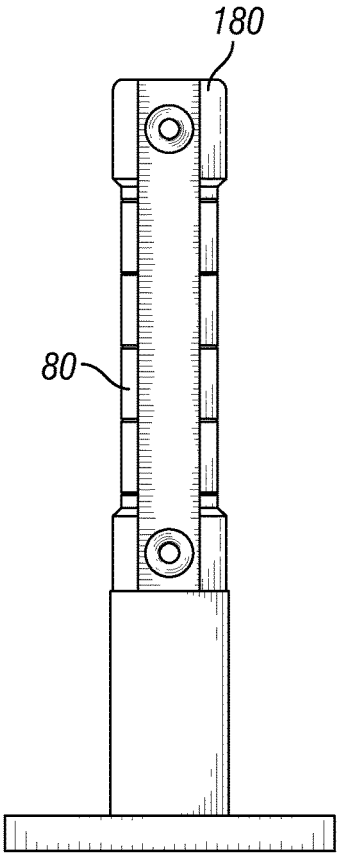
FIG. 6 is a rear view of a bracing post for a former assembly in an illustrative embodiment.
Figure 7:
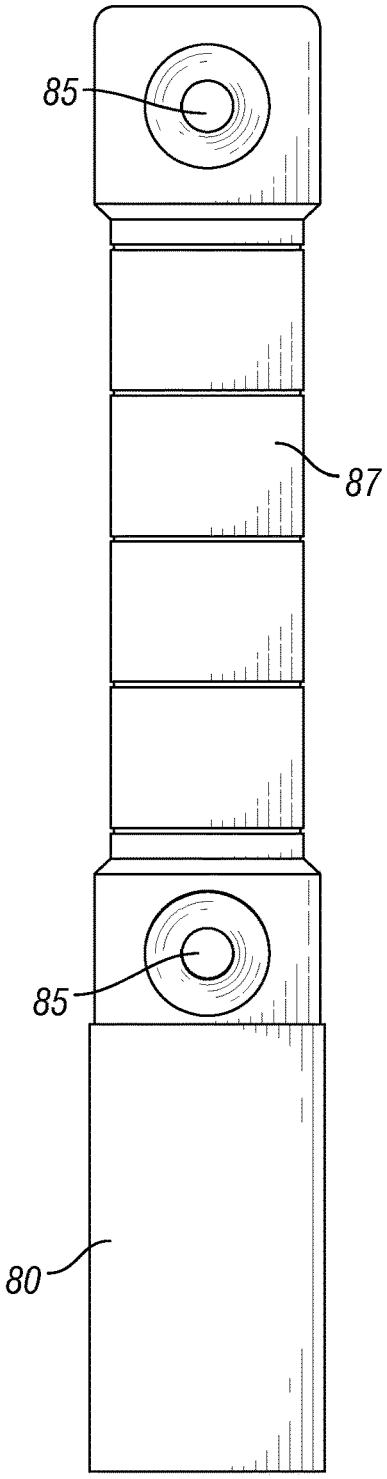
FIG. 7 is a front view of a bracing post for a former assembly in an illustrative embodiment.
Figure 8:
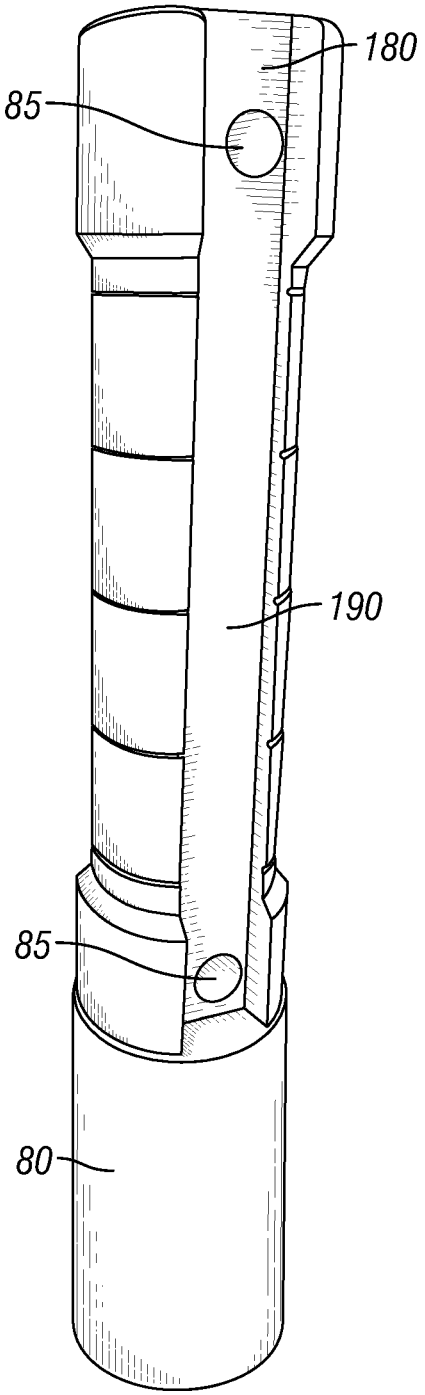
FIG. 8 is a rear perspective view of a bracing post for a former assembly in an illustrative embodiment.
Figure 9A:
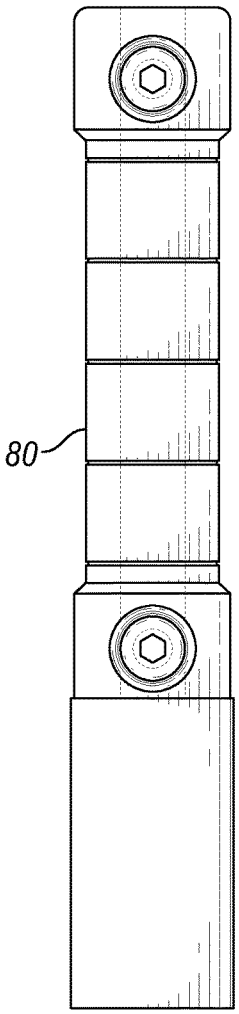
FIG. 9A is a front view of a bracing post for a former assembly in an illustrative embodiment.
Figure 9B:
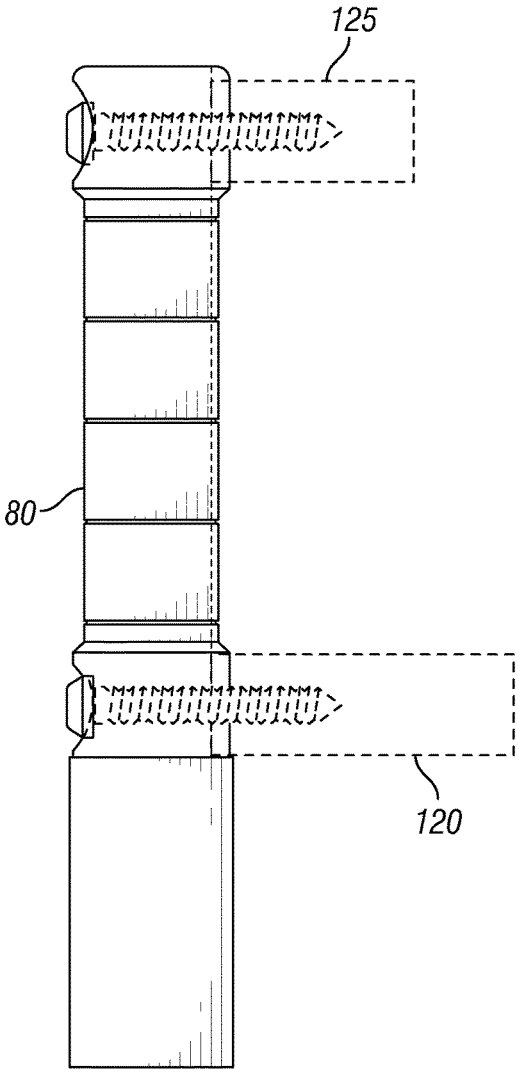
FIG. 9B is a side view of a bracing post for a former assembly in an illustrative embodiment.
Figure 10:
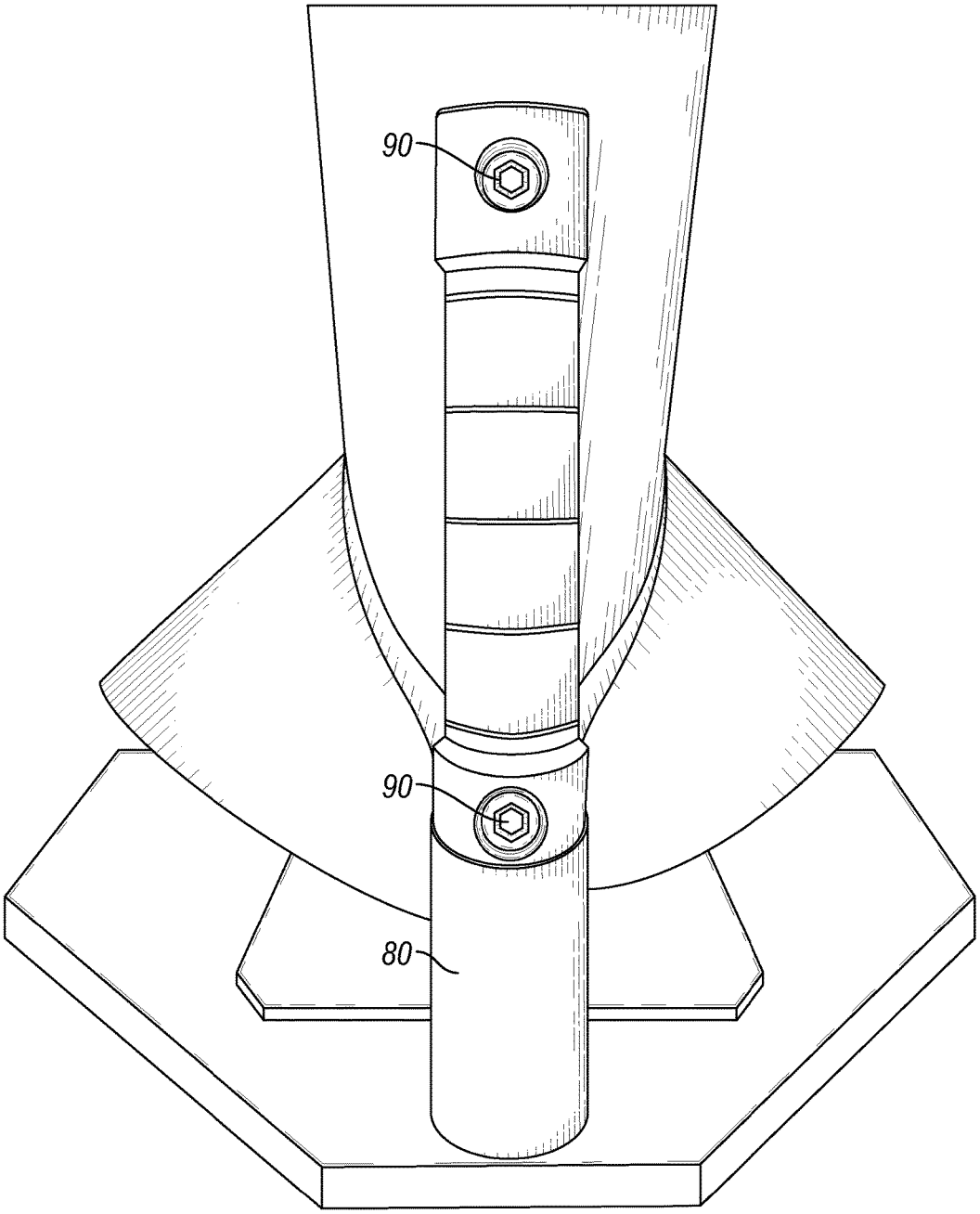
FIG. 10 is a front view of a former assembly and bracing post in an illustrative embodiment.

In certain illustrative embodiments, bracing post 80 can have a generally circular cross section. As shown in FIGS. 3 and 4, bracing post 80 can have a solid, non-hollow construction along its central longitudinal axis. A receiving groove 180 can be formed within bracing post 80. Receiving groove 180 can extend throughout the entire longitudinal extent of bracing post 80, or alternatively, can extend only partially therealong. In certain illustrative embodiments, receiving groove 180 can be formed along a side edge of bracing post 180, in a location that is not along the central longitudinal axis of bracing post 80. Receiving groove 80 can be aligned so that it faces funnel section 30 (see FIGS. 11 and 12). Receiving groove 180 can have a variety of shapes. For example, receiving groove 180 can have a rectangular shape, with a rear wall 182 and a pair of side walls 181 (see FIG. 3), or a semicircular or "U" shape with a rear section 182 and a pair of side sections 181 (see FIG. 4), either of which shapes define a receiving area.

In certain illustrative embodiments, one or more contact arms 120, 125 can be attached to fill tube 20, preferably at or near funnel section 30. Contact arms 120, 125 can extend outward from fill tube 20 and have a shape that would allow at least part of contact arms 120, 125 to slidingly fit at least partially within receiving groove 180 of bracing post 80 when fill tube 20 is positioned within the central aperture 310 of base plate 40 (see FIGS. 11 and 12). Thus, the section of contact arms 120, 125 that fits within receiving groove 180 of bracing post 80 should be aligned in a plane that is perpendicular to the plane of bracing post 80.

In certain illustrative embodiments (e.g., FIGS. 9-12), one or more stabilizer pins 90 can be disposed within bracing post 80. For example, stabilizer pins 90 can fit within one or more bracing orifices 85 formed in the wall of bracing post 80. One or more locking orifices 121 can be formed in contact arms 120, 125. Locking orifices 121 can be sized such that stabilizer pins 90 can fit within and pass through locking orifices 121 when contact arms 120, 125 are fitted within bracing post 80. In certain illustrative embodiments, bracing orifices 85 in bracing post 80 are aligned such that the openings of bracing orifices 85 face funnel section 30 of fill tube 20 and are aligned with locking orifices 121 of contact arms 120, 125. Stabilizer pins 90 can comprise pins, knobs, bolts, screws or other similar securing means, and can secure contact arms 120, 125 to bracing post 80 and prevent accidental removal.

Figure 11:
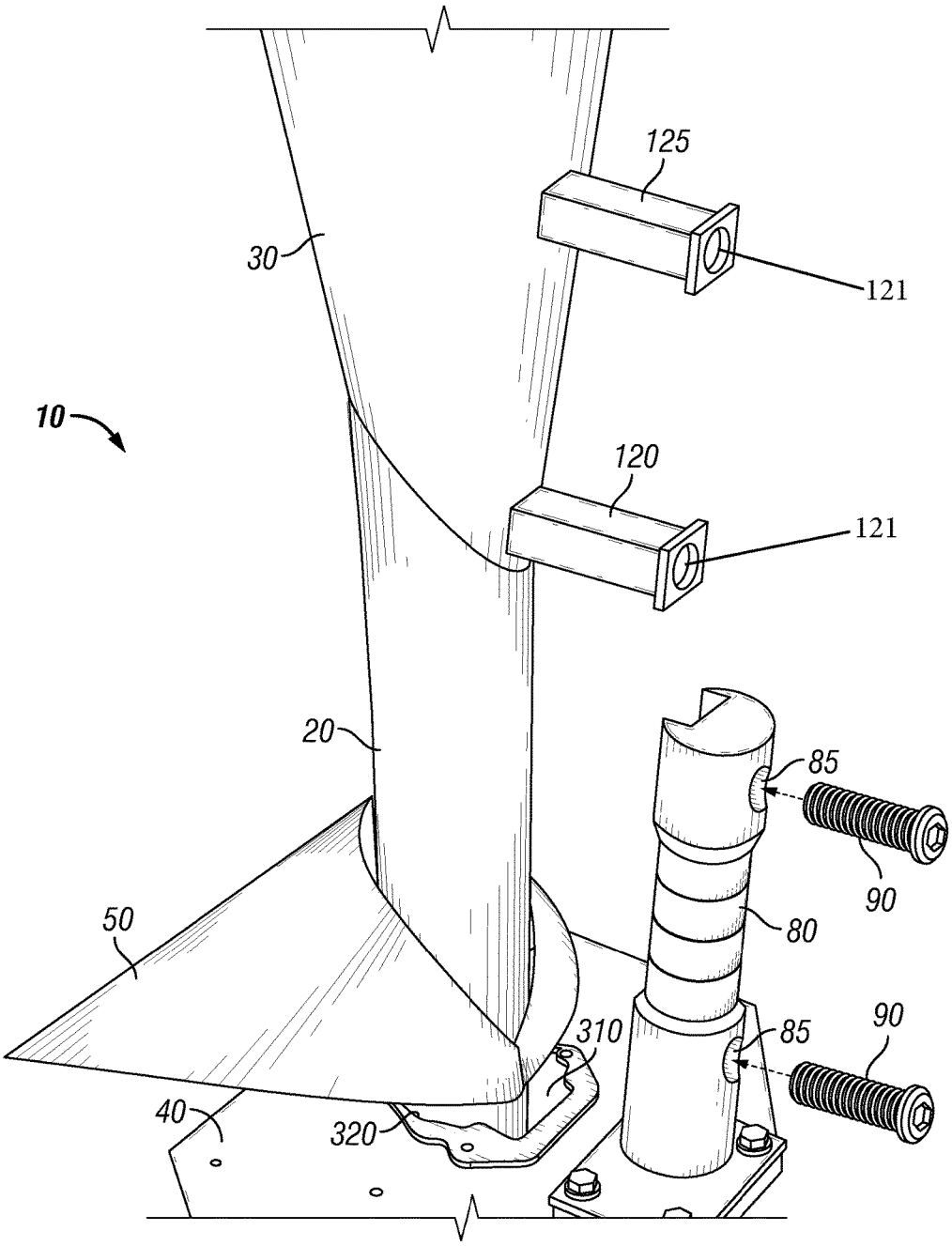
FIG. 11 is a perspective view of a former assembly with the fill tube disengaged from the bracing post in an illustrative embodiment.
Figure 12:
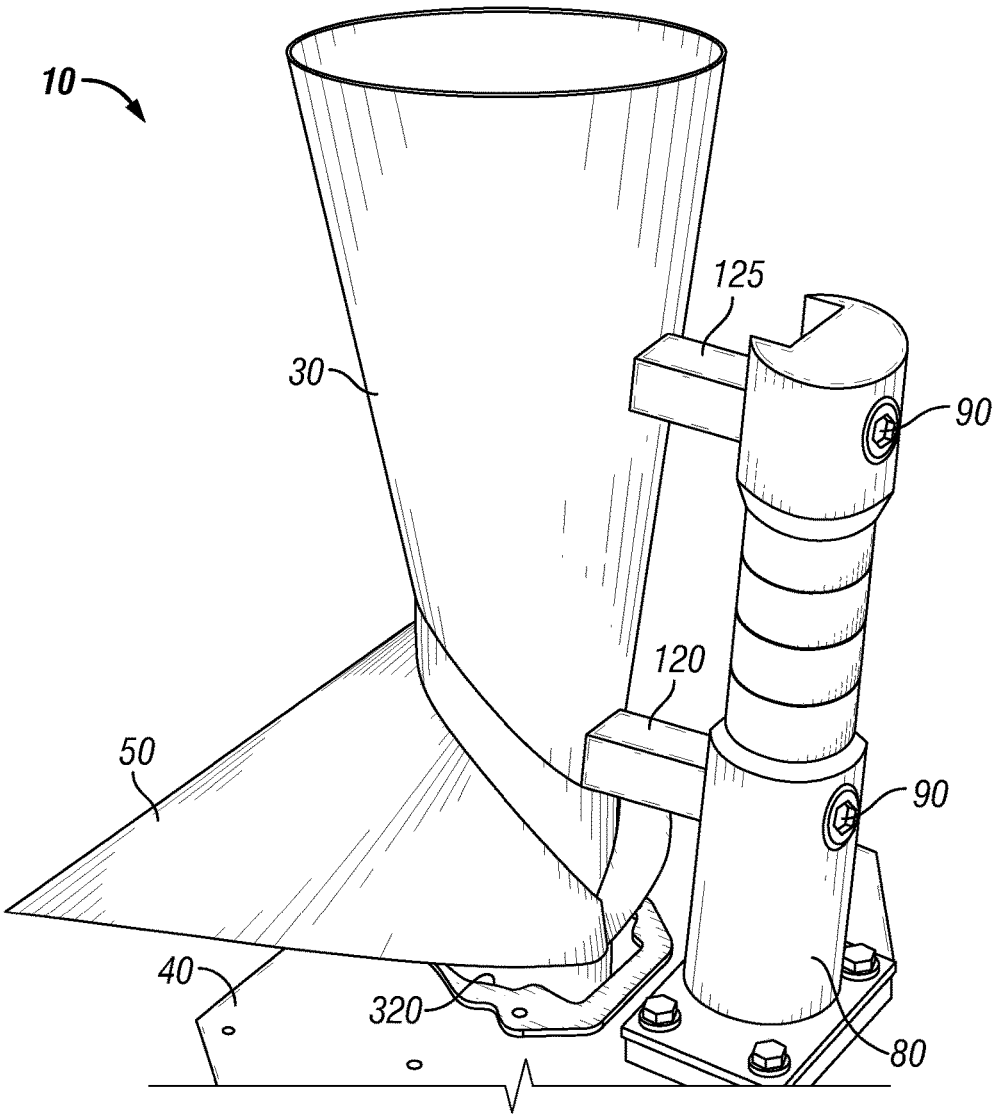
FIG. 12 is a perspective view of a former assembly with the fill tube engaged with the bracing post in an illustrative embodiment.
Figure 13:
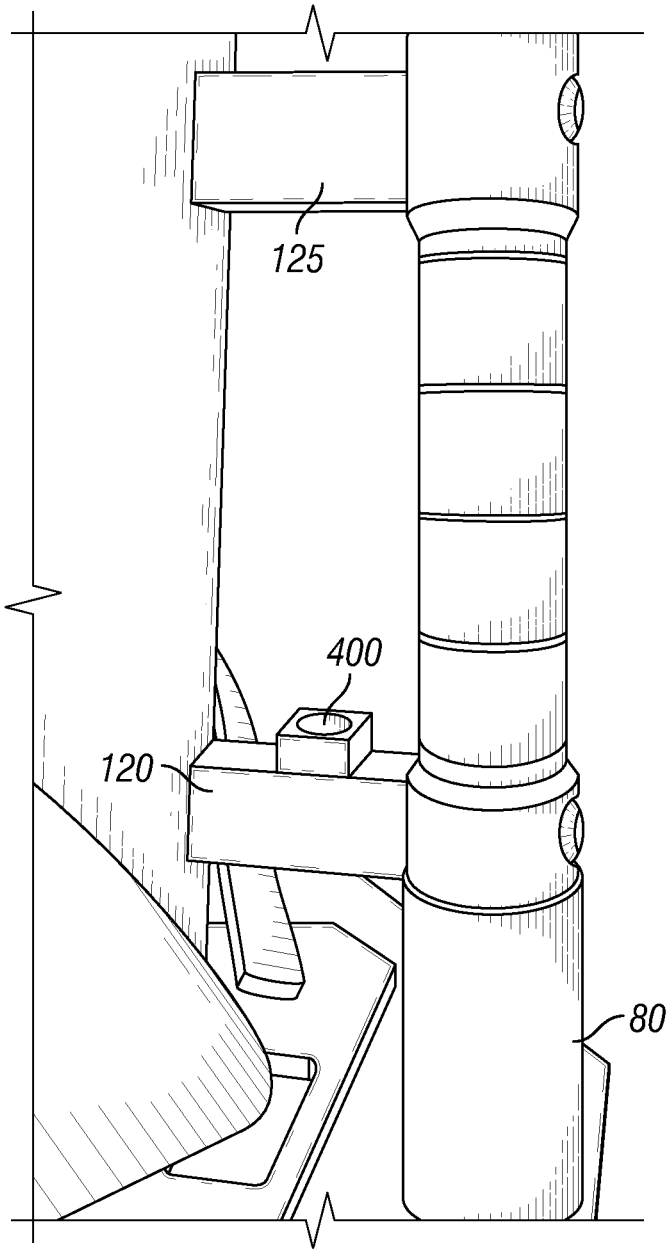
FIG. 13 is a side view of a former assembly with a contact arm having a gas intake nozzle in an illustrative embodiment.
Figure 14:
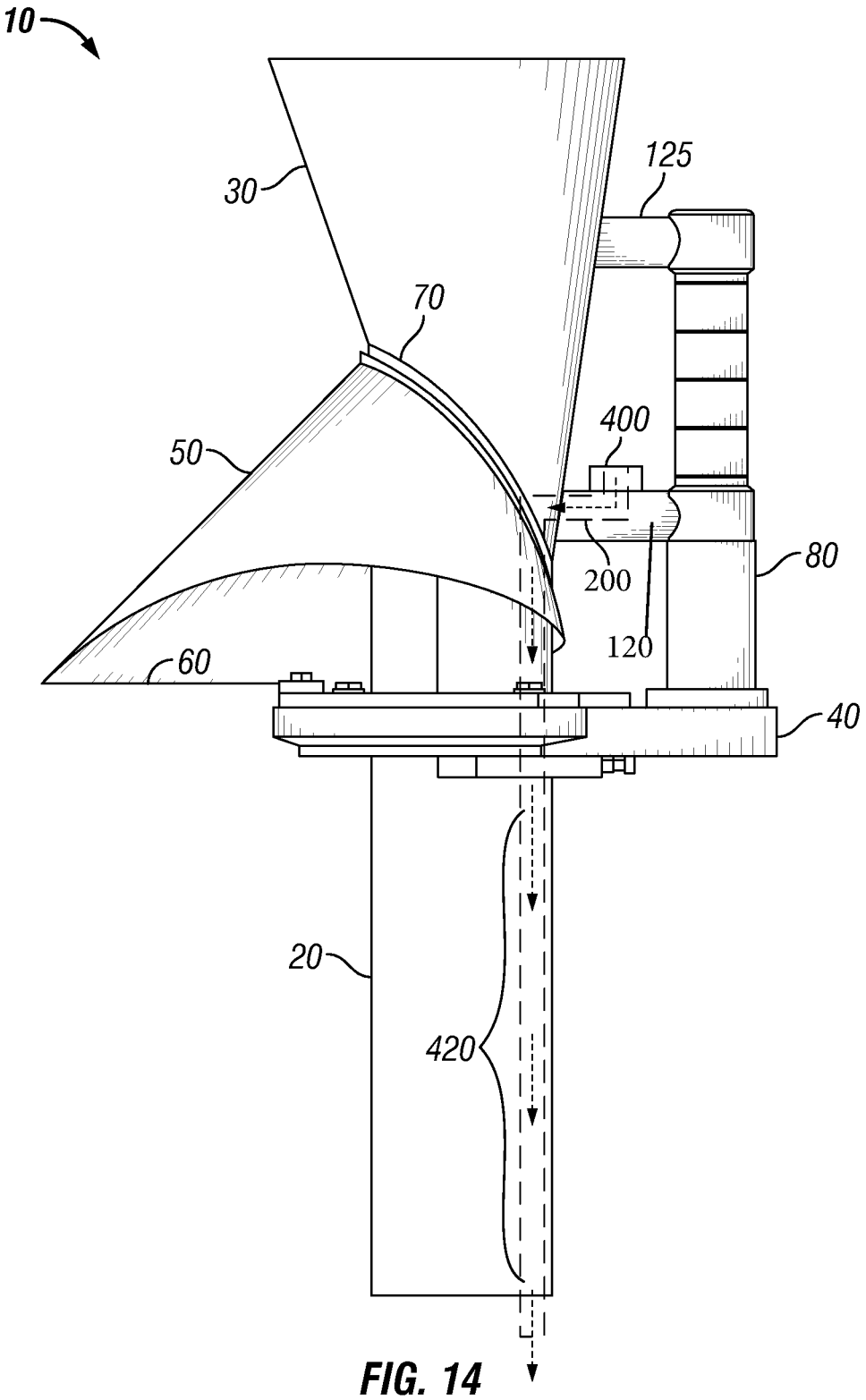
FIG. 14 is a is a side view of a former assembly with a contact arm having a gas intake nozzle and a fill tube having a gas flow conduit an illustrative embodiment.
Figure 15:
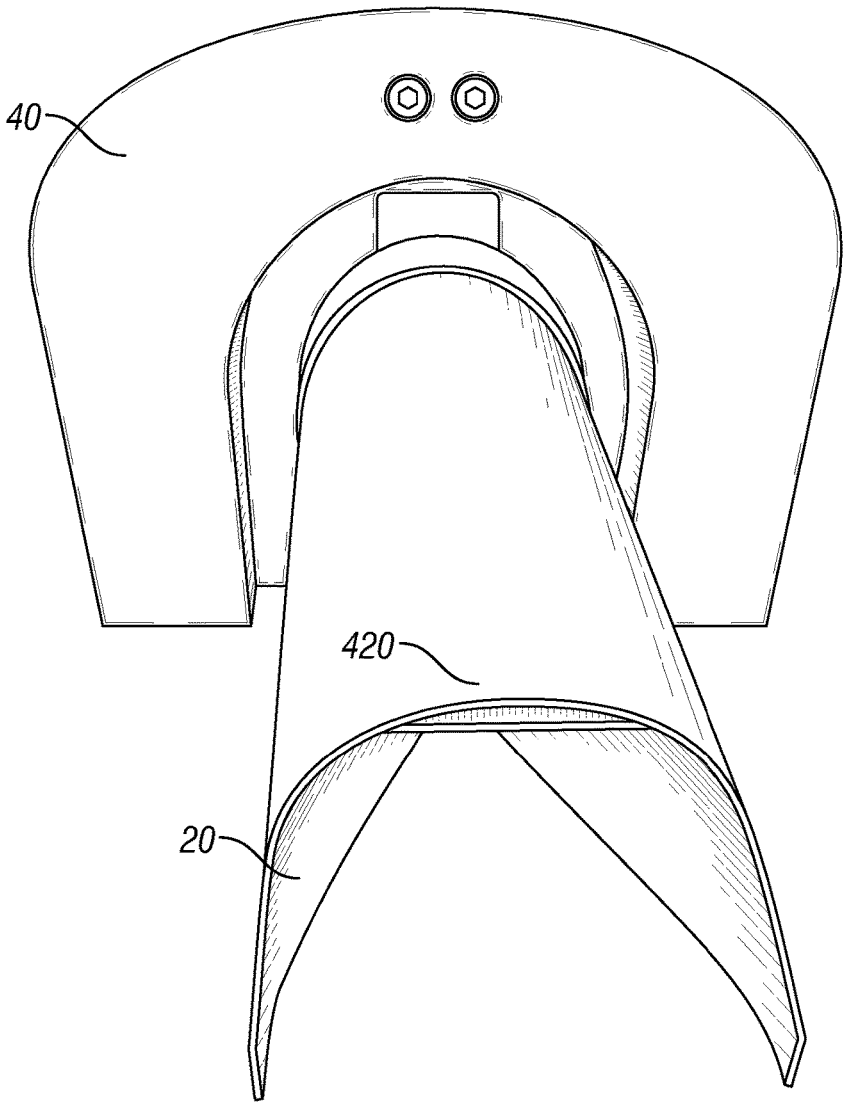
FIG. 15 is a top view of a former assembly with a fill tube having a gas flow conduit in an illustrative embodiment.
Figure 16:
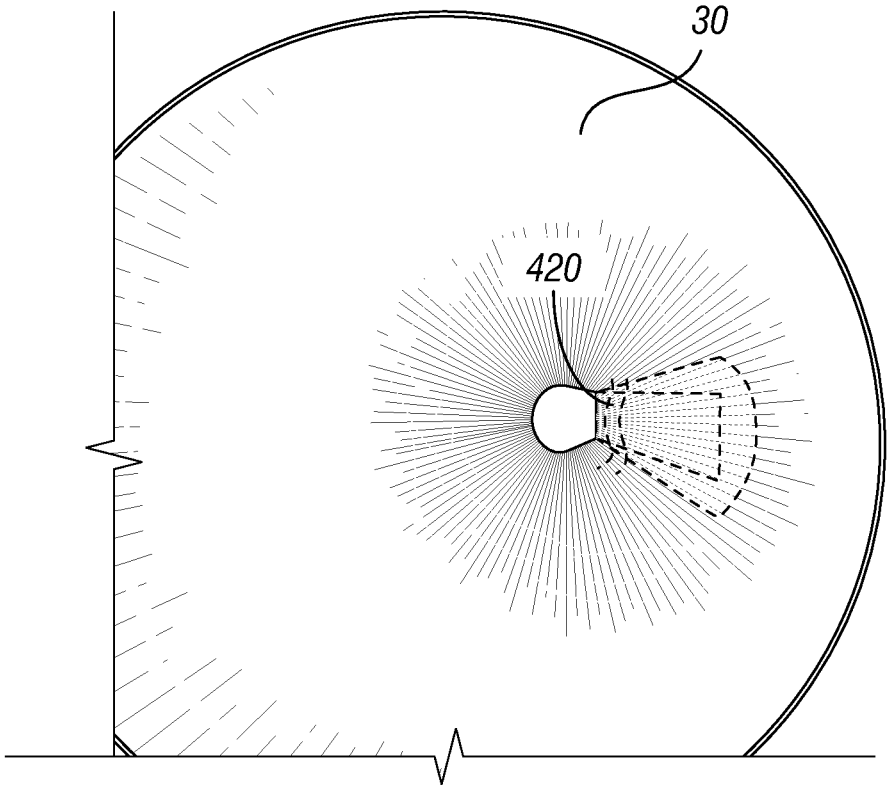
FIG. 16 is a top view of a fill tube having a gas flow conduit in an illustrative embodiment.

Fill tube 20 may be separated or removed from assembly 10 (as for cleaning) by, for example, slideably removing contact arms 120, 125 from receiving groove 180 of bracing post 80. Replacement of fill tube 80 on assembly 10 may be accomplished by, for example, reversing the above-described steps and slideably inserting contact arms 120, 125 into receiving groove 180 of bracing post 80. In this regard, FIGS. 11-12 show various views of assembly 10 wherein contact arms 120, 125 are fully separated or removed from, or fully or partially disposed within, receiving groove 180 of bracing post 80 in certain illustrative embodiments.

In certain illustrative embodiments, a gas intake nozzle 400 can be disposed on apparatus 10. An inert gas (such as nitrogen gas) can be ported into gas intake nozzle 400 and then delivered through a first gas flow conduit 200 to fill tube 20 and into the product packaging to keep the product fresh or for other desired purposes. First gas flow conduit 200 can be disposed on contact arm 120. As used herein, the term "on" means, for example, on an exterior of contact arm 120 or within an interior region of contact arm 120.

In certain illustrative embodiments, gas intake nozzle 400 can be positioned on assembly 10 in a location such that the inert gas delivered via gas intake nozzle 400 is not forced to travel though a significant portion of funnel section 30, where it could interact with and disrupt and/or interfere with the flow of products through funnel section 30.

For example, gas intake nozzle 400 can be disposed on at least one of contact arms 120, 125. In certain illustrative embodiments, contact arms 120, 125 can comprise an upper positioned contact arm 125 and a lower positioned contact arm 120 (when assembly 10 is positioned in an upright orientation), and gas intake nozzle 400 can be disposed on lower positioned contact arm 120, where there is less opportunity for the inert gas to interact with the materials in funnel section 30. See FIGS. 14-16.

In certain illustrative embodiments, lower positioned contact arm 120 is located below the uppermost portion of wing 50 and/or near the lowermost portion of funnel section 30. At this location, gas injected into lower positioned contact arm 120 would not come into contact with the flow of products being passed through the uppermost portion of funnel section 30. When the inert gas is being delivered to the product packaging, the gas can be injected into gas intake nozzle 400, transported through first gas flow conduit 200 and into fill tube 20 near the lowermost section of funnel section 30, and then passed into fill tube 20 to be delivered to the product packaging.

In certain illustrative embodiments, fill tube 20 can have a second gas flow conduit 420 formed therein. Second gas flow conduit 420 can be a blocked-off region inside of fill tube 20 where inert gas can travel while being isolated from the products that are passing through fill tube 20 and delivered from funnel section 30. In certain illustrative embodiments, first gas flow conduit 200 is operatively connected to second gas flow conduit 420 such that inert gas can travel from lower positioned contact arm 120 into fill tube 20.

In certain illustrative embodiments, second gas flow conduit 420 can be disposed against a side interior wall of fill tube 20. In general, the length and width of second gas flow conduit 420 can be sized and adjusted as necessary to achieve the desired flow rate and distribution into the product packaging. The top end of second gas flow conduit 420 can be disposed adjacent to lower positioned contact arm 120, if gas intake nozzle 400 is disposed on lower positioned contact arm 120, or alternatively, the top end of second gas flow conduit 420 can be disposed adjacent to upper positioned contact arm 120, if gas intake nozzle 400 is disposed on upper positioned contact arm 120.

The various illustrative embodiments of the bag forming assembly described herein are stable and easy to disassemble, reassemble and align for cleaning and maintenance purposes without tools or extensive experience. The various components of the bag forming assembly are formed of stainless steel and designed to lock into one another seamlessly, and provide improved stability and reduction in unwanted movement during operation as compared to previous designs.

It is to be understood that the invention is not limited to the exact details of construction, operation, exact materials, or illustrative embodiments shown and described, as modifications and equivalents will be apparent to one skilled in the art. For example, the size and shape of the receiving orifice and bracing post can also be rectangular, polygonal or any shape desired by the user. Accordingly, the invention is therefore to be limited only by the scope of the appended claims.

What is claimed is:

1. A former assembly for forming bags from flexible sheet material comprising:

a base plate having an aperture formed therein;

a single bracing post attached to the base plate proximate to the aperture, the bracing post having a receiving groove formed along a side edge thereof;

a fill tube slidingly passable through the aperture in the base plate with an annulus between the fill tube and the base plate sized for the passage of the flexible sheet material;

a plurality of contact arms attached to the fill tube at spaced apart locations, the contact arms each extending from the fill tube and slidingly fittable into the receiving groove, wherein the receiving groove is sized to receive the contact arms when the fill tube is slidingly passed through the aperture in the base plate;

a locking orifice formed in each of the plurality of contact arms; and a plurality of bracing orifices formed in the bracing post.

2. The assembly of claim 1, further comprising a stabilizer pin slidingly fittable through at least one of the bracing orifices and within the locking orifice on one of the contact arms and capable of securing the contact arm to the bracing post.

3. The assembly of claim 1, wherein the plurality of contact arms are slidingly fittable in the receiving groove and aligned perpendicular to the bracing post.

4. A method of removing a fill tube from a former assembly for fabricating bags from flexible sheet material, the former assembly having a base plate with an aperture formed therein, a single bracing post attached to the base plate proximate to the aperture, and a fill tube with a plurality of contact arms attached thereto at spaced apart locations, the fill tube disposed in the aperture in the base plate, and the bracing post having a receiving groove formed on a side wall thereof that is sized to receive the contact arms such that the contact arms are disposed therein, the method comprising:

slidingly passing the fill tube out of the aperture in the base plate;

slidingly removing the contact arms out of the receiving groove such that the contact arms are no longer disposed within the receiving groove; and removing a locking pin from a locking orifice formed in at least one of the contact arms and from one of a plurality of bracing orifices formed in the bracing post to unsecure the at least one of the contact arms from the bracing post.

5. A method of replacing a fill tube from a former assembly for fabricating bags from flexible sheet material, the former assembly having a base plate with an aperture formed therein, an annulus between the fill tube and the base plate sized for the passage of the flexible sheet material, a single bracing post attached to the base plate proximate to the aperture, and a fill tube with a plurality of contact arms attached thereto at spaced apart locations, the fill tube disposed in the aperture in the base plate, and the bracing post having a receiving groove formed on a side wall thereof that is sized to receive the contact arms such that the contact arms are disposed therein, the method comprising:

slidingly passing the fill tube through the aperture in the base plate;

engaging the contact arms with the bracing post;

slidingly fitting the contact arms into the receiving groove such that the contact arms are disposed within the receiving groove; and inserting a locking pin into a locking orifice formed in at least one of the contact arms and into one of a plurality of bracing orifices formed in the bracing post to secure the at least one of the contact arms to the bracing post.

6. The assembly of claim 1, further comprising a gas intake nozzle disposed on at least one of the contact arms; and a gas flow conduit disposed on said at least one of the contact arms and capable of delivering gas from the gas intake nozzle to an interior region of the fill tube.

7. The assembly of claim 6, wherein the plurality of contact arms comprises an upper positioned contact arm and a lower positioned contact arm when the assembly is positioned in an upright orientation, and wherein the gas intake nozzle and the gas flow conduit are disposed on the upper positioned contact arm.

8. The assembly of claim 6, wherein the plurality of contact arms comprises an upper positioned contact arm and a lower positioned contact arm when the assembly is positioned in an upright orientation, and wherein the gas intake nozzle and the gas flow conduit are disposed on the lower positioned contact arm.

9. The assembly of claim 6, wherein the gas flow conduit comprises a first gas flow conduit, and the assembly further comprises a second gas flow conduit disposed within the interior region of the fill tube, and wherein the first gas flow conduit and the second gas flow conduit are connected such that inert gas can flow therebetween.

* * * * *